US005400919A

United States Patent [19]

Gomm et al.

[11] Patent Number: 5,400,919

[45] Date of Patent: Mar. 28, 1995

[54] SINGLE COPY MEDIA DISPENSING MACHINE

[76] Inventors: R. Gregg Gomm; R. Gary Gomm, both of 27025 Smithson Valley Rd., San Antonio, Tex. 78261

[21] Appl. No.: 132,460

[22] Filed: Oct. 6, 1993

[51] Int. Cl.[6] ..... G07F 11/00

[52] U.S. Cl. ..... 221/195; 221/225; 221/231; 221/258; 221/247

[58] Field of Search ..... 221/231, 194, 195, 193, 221/225, 251, 236, 258, 247, 248

[56] References Cited

U.S. PATENT DOCUMENTS

| | | | |
|---|---|---|---|
| 2,396,411 | 3/1946 | Cameron | 221/231 |
| 4,473,172 | 9/1984 | Reynolds | 221/231 |
| 4,591,069 | 5/1986 | Stewart | 221/231 |
| 4,625,894 | 12/1986 | James et al. | 221/193 |
| 4,667,803 | 5/1987 | Gordon | 221/231 |
| 5,067,605 | 11/1991 | Gordon | 221/231 |
| 5,197,589 | 3/1993 | Gordon | 221/195 |
| 5,199,599 | 4/1993 | Shade | 221/231 |

*Primary Examiner*—H. Grant Skaggs

*Attorney, Agent, or Firm*—David G. Henry

[57] ABSTRACT

Applicant's invention comprises a single-vend dispensing machine particularly applicable to vending newspapers. The apparatus includes a platform along which a supply of newspapers (or magazines) are advanced by a specially configured push plate. Individual copies are advanced to a vend position by operation of a frictional roller which engages the foremost single copy and advances it over a platform edge to a vend position. A copy in the vend position rests against a trap door a lock for which is briefly disengaged upon payment by a customer for allowing the copy to fall to an access slot for recovery by the customer. After removal of the copy, a new copy is advanced to the vend position by friction roller. A biased bailer aids in maintaining the front-most copy in the appropriate position for falling into the vend position, which bailer is released upon actuation of the friction roller. A central control module actuates each motor and solenoid of the device, according to appropriate actuation by a customer and to input from sensors indicating pertinent positions or locations of copies.

3 Claims, 6 Drawing Sheets

SINGLE COPY MEDIA DISPENSING MACHINE

BACKGROUND OF THE INVENTION

1. Field of the Invention

Applicant's invention relates to vending machines.

2. Background Information

Presently, there is a need for an effective dispensing or vending machine which is useful, particularly for dispensing single copies of newspapers. At the same time, there is a need for such machines which accept other than cash so as to alleviate problems of theft.

It is common knowledge that present day newspaper vending "racks" allow access to complete inventories of newspapers each time a purchaser inserts the necessary coinage for purchasing a single newspaper. Collectively, newspaper publishers in this country lose millions of dollars each year to persons who access the newspaper inventories by, in many cases, inserting a single quarter, and who take, in some cases, the entire inventory for resale, to accumulate valuable coupons, as a teenage prank, or any number of other reasons.

It is also common knowledge that theft of coins from newspaper vending machines (or even of the entire machines themselves for later access to the coins) presents an additional serious problem for newspaper publishers. Not only is the revenue from newspaper sales lost, but the dispensing machines are themselves either damaged or lost altogether.

Further still, given the consumer access to complete newspaper inventory at each purchase, combined with the cash-only tender used with the machines, publishers are wholly at the mercy of their route collectors to honestly report and submit to the publisher the actual revenues found in the racks. It is far too easy to simply claim that someone "must have taken all the papers with just one quarter".

SUMMARY OF THE INVENTION

It is an object of the present invention to provide a novel single-copy dispensing machine, particularly useful for dispensing newspapers.

It is another object of the present invention to provide a newspaper vending machine which prohibits access by consumers to more than the number of copies for which they pay.

It is an object of the present invention to provide a novel single-copy dispensing machine, particularly useful for dispensing newspapers, the construction of design of which renders it cost-effective for purchase by publishers.

It is another object of the present invention to provide a newspaper vending machine which is particularly suited for use with cash-alternative purchasing media.

It is an object of the present invention to provide a novel single-copy dispensing machine, particularly useful for dispensing newspapers, which machine will effectively, without day-to-day adjustment, dispense newspapers a widely varying volume.

In satisfaction of these and related objectives, Applicant's present invention provides a novel and unobvious newspaper dispensing machine which is capable of effectively dispensing single copies of any of a wide array of newspaper sizes or thicknesses. Because of its electromechanical actuation, Applicant's machine is particularly well suited for actuation by apparatuses which accept cash alternatives, such pre-paid smart cards. For the same reason, Applicant's machine is well suited for clustering with additional units displaying papers (or even magazines) of multiple publishers, each unit of which can be actuated from a single, electronic governing mechanism which actuates the appropriate unit based on the money (or cash alternative) inserted by a purchaser, together with the item selection made by the purchaser (much like a snack vending machine).

Applicant's machines permit their users to:

(1) prevent the unfettered theft of newspaper or magazine copies as allowed by access to entire inventories when using present day newspaper "racks";

(2) provide their customers with the convenience of virtually "being handed" their newspaper as opposed to having to deal with cumbersome spring-loaded doors of present day racks;

(3) increase revenues by facilitating the replacement of theft-attractive coinage with non-cash purchasing media which is either effectively unavailable or at least unattractive to thieves; and (4) to increase revenues through their ability to verify the number of transactions actually made, thereby reducing the likelihood of fraud or embezzlement at the route management level.

DETAILED DESCRIPTION OF THE PREFERRED EMBODIMENT

Figure 1:
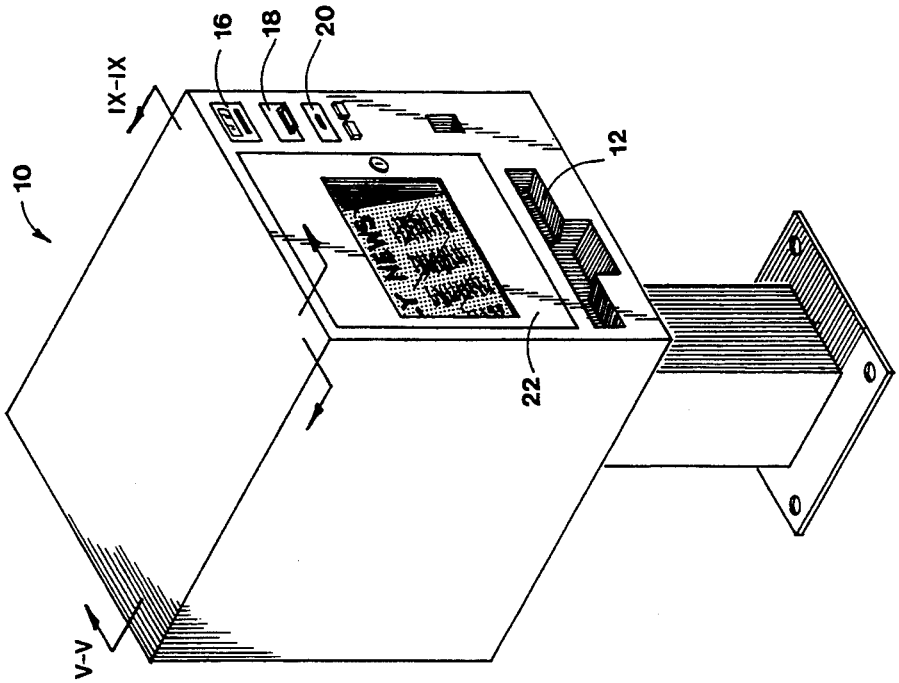
FIG. 1 is a perspective view of a preferred embodiment of a single-unit dispensing machine of Applicant's invention.

Referring to FIG. 1, a single unit dispensing machine of Applicant's invention is depicted by the reference numeral 10. One will note that machine 10 exhibits a slot 12 through which a newspaper 14 is delivered to a customer. Slot 12 is positioned, sized and shaped such that there is no access to the newspaper inventory inside machine 10. As will be explained in greater detail below, upon actuation of machine 10 by payment of the required purchase price, a single copy of a newspaper 14 drops to the level of slot 12 for access by the customer.

Also depicted in FIG. 1 on machine 10 are several payment media receptacles. Smart card reader/writer 16 represents Applicant's preferred payment mode in transactions involving machine 10. Both smart cards (not shown in FIG. 1 and appropriate reader/writers are available from the Schlumberger Technologies company in Chesapeake, Va. In short, such smart cards exhibit microprocessors and memory modules into which is stored data which, according to a protocol, represents a monetary equivalent. This data is readable and modifiable by the smart card reader/writer such that a user's balance on his or her smart card is debited, and a transaction register memory inside machine 10 is credited each time a customer purchases a newspaper (or magazine). No cash is involved.

The system for using smart cards with machine 10 can be most easily understood by following the path of money through the system. A card issuer (in this case we will assume a "closed system" where the issuer is the vendor) will sell smart cards, encoded for certain indicated face values, to distributors (grocery stores, banks, convenience stores, post offices, etc.) for a discounted price. The distributors then sell the cards at face value to consumers, thereby making their profit and realizing the needed motivation to participate in the program.

When purchasing newspapers from machines 10, customers will insert their smart cards into reader/-writer 16 and receive a newspaper. No cash is involved.

Referring still to FIG. 1, there is also shown a bill reader 18 for accepting paper currency, and a coin slot 20. The inventory access door 22 is key locked and is accessible only by the route manager services and supplies machine 10.

Figure 4:
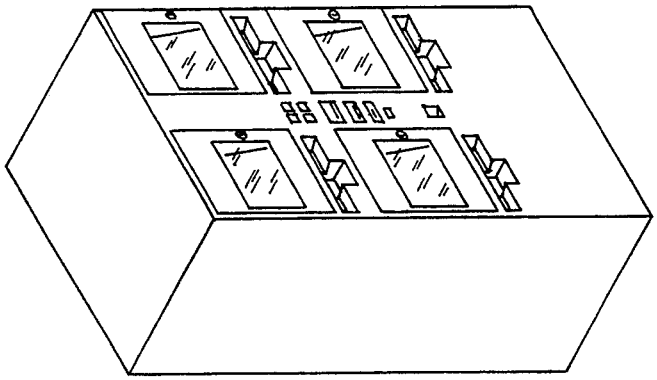
FIG. 4 is a four-unit cluster of preferred embodiment dispensing machines of Applicant's invention, and a depiction of Applicant's preferred embodiment of actual application of the invention.
Figure 3:
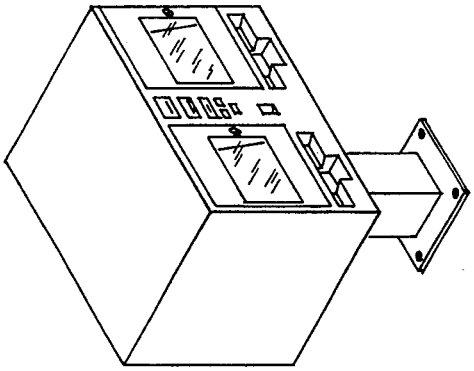
FIG. 3 is a perspective view of a dual-unit cluster of preferred embodiment dispensing machines of Applicant's invention.
Figure 2:
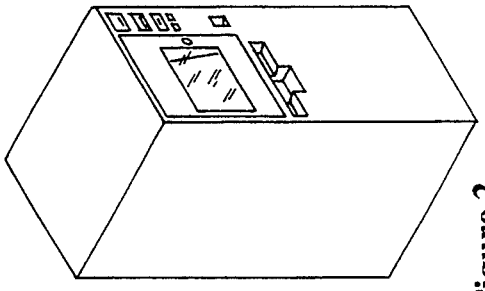
FIG. 2 is a perspective view of the unit of FIG. 1 in a slightly different case configuration.

FIGS. 2, 3 and 4 depicted differing encasement or clustering options for machines 10. Particularly with respect to the configurations shown in FIGS. 3 and 4, it should be noted that a single control unit (not depicted in the drawings) can actuate each individual machine 10. Such a control unit is analogous to snack vending machine control units which both "count" the money tendered by the customer and process a product selection by the customer. Given the electro-mechanical basis for machines 10, use of such a control unit is this context is easily achievable by anyone reasonably skilled in the art.

Figure 5:
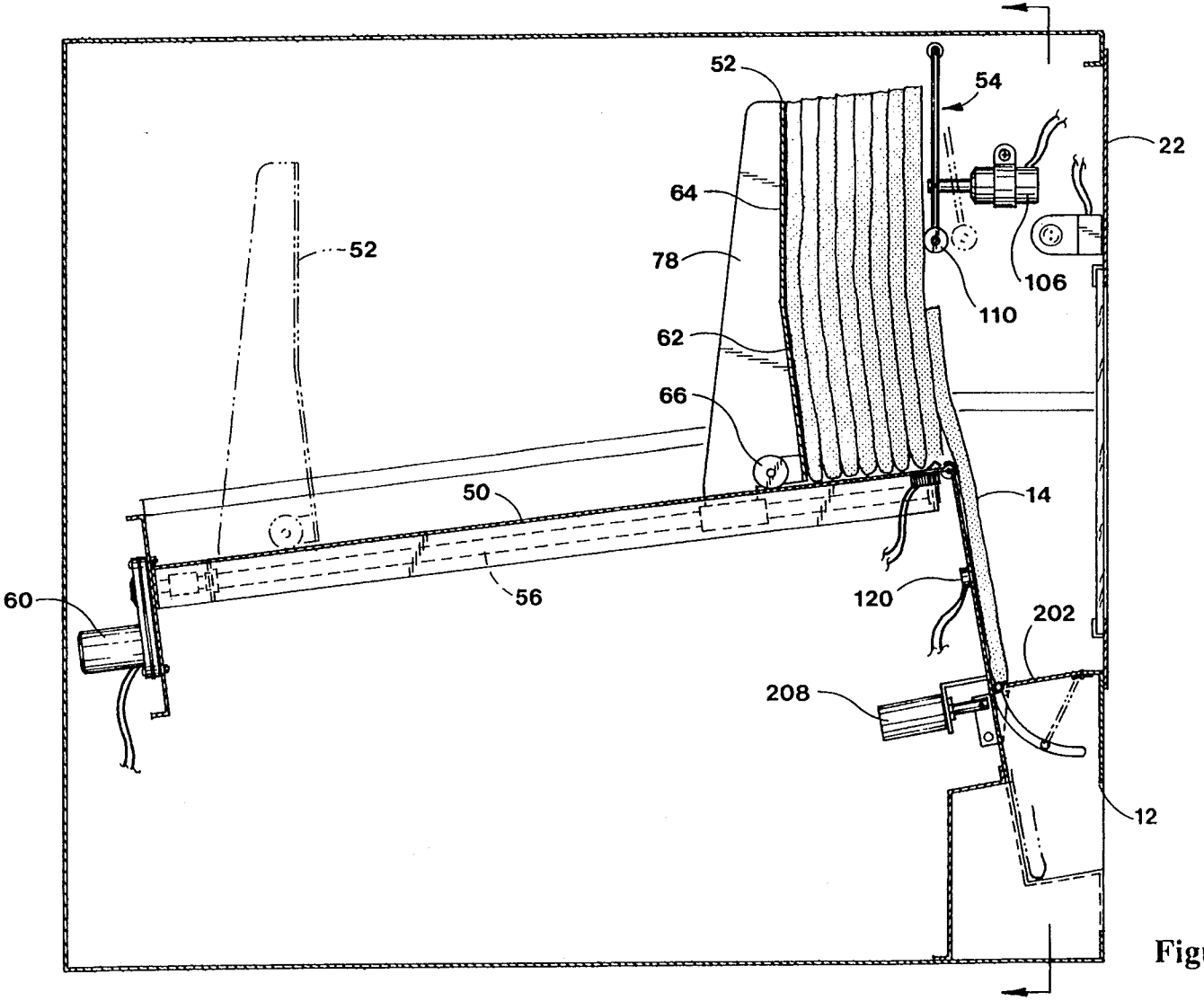
FIG. 5 is an elevational side cross-sectional view of FIG. 1 along line V—V and showing interior components of Applicant's dispensing machine with the push plate 52 thereof being depicted in solid line depiction at a position for supporting an existing inventory of newspapers and in dotted-line depiction in a position for re-loading the dispensing machine.
Figure 8:
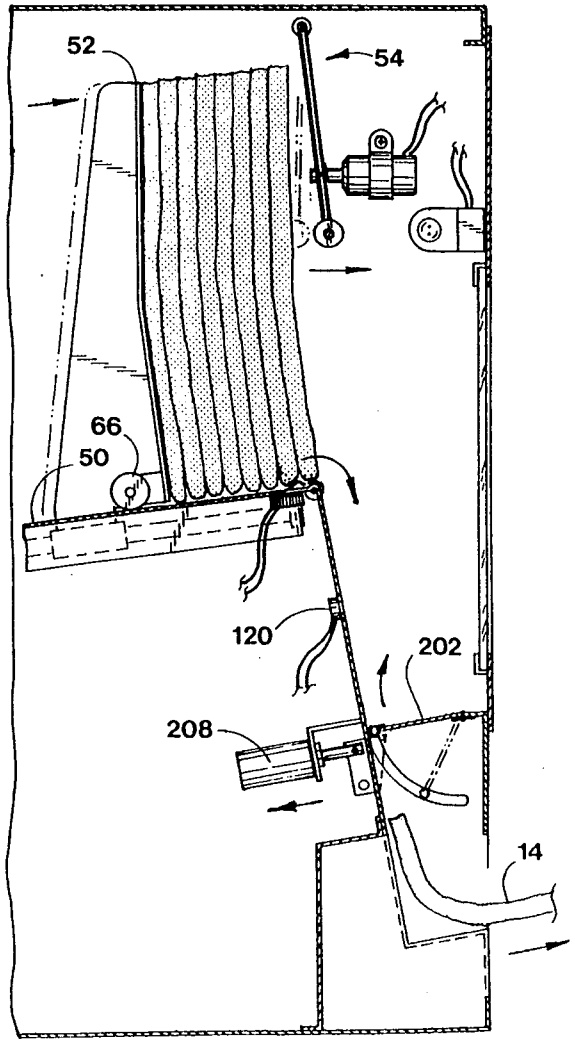
FIG. 8 is a modified depiction of FIG. 7 with the trap door having returned to its pre-vend position, prior to advancement of a subsequent newspaper to the pre-vend position.
Figure 7:
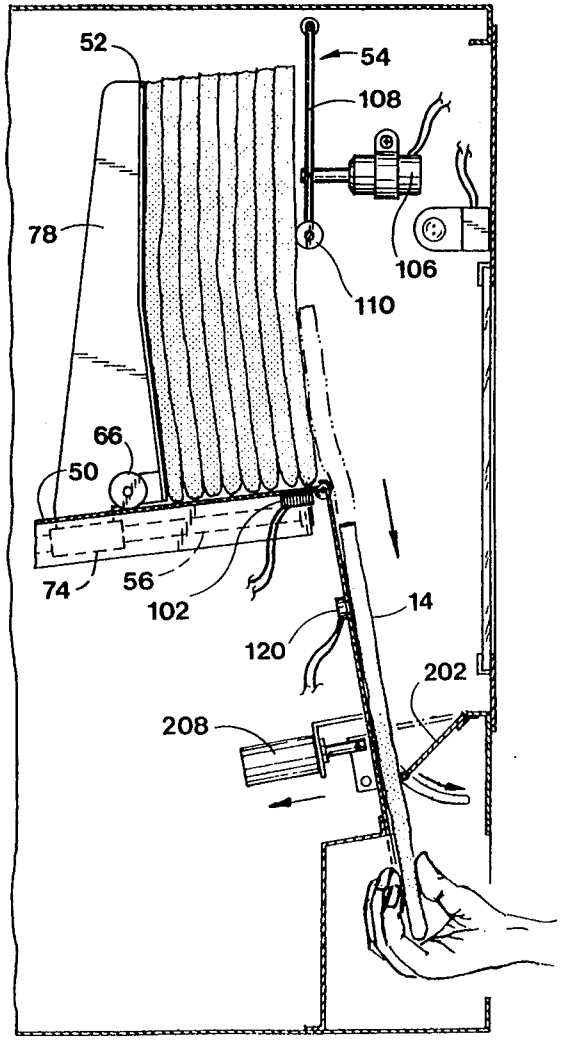
FIG. 7 is a modified depiction of FIG. 6 with the machine having been actuated by a customer and the newspaper, by way of momentary release of the trap door locking mechanism, being delivered to the customer.
Figure 6:
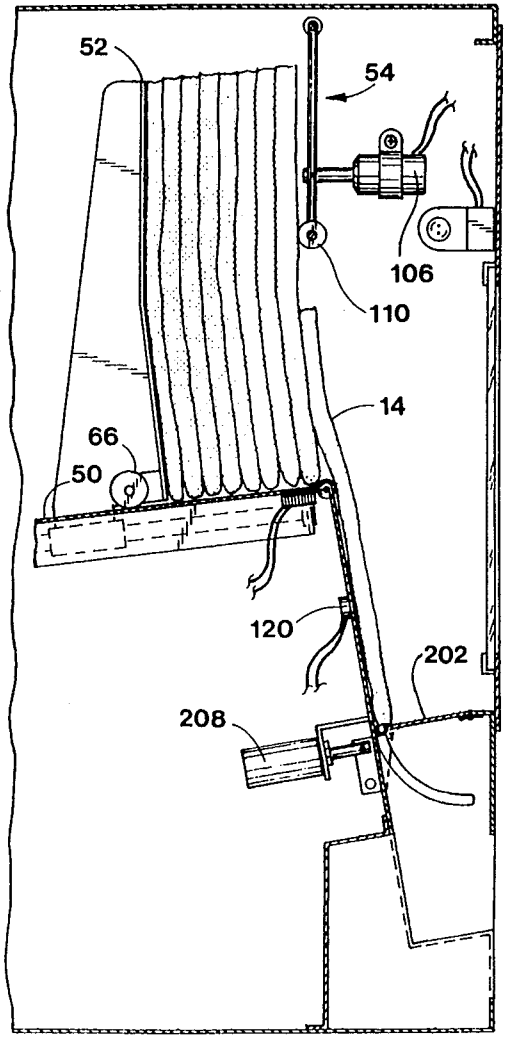
FIG. 6 a partial elevational side cross-sectional view of FIG. 1 along line V—V and showing the forward-most portion of the internal components of a preferred embodiment of Applicant's invention, with a newspaper in position for delivery to the next customer who actuates the machine.

Referring to FIG. 5 the delivery sequence of a single newspaper 14 and involved apparatus components of machine 10 will be described. Newspapers 14 in machine 10 "ride" on a platform 50 with their folded, or "spine" edges resting against platform 50. Newspapers 14 are maintained in their upright orientation as depicted in FIG. 5, in part, by push plate 52 which, as will be described in more detail hereafter, advance the newspapers 14 toward the forward end of the machine 10 after each purchase by a customer. A review of FIG. 5 will show that platform 50 is in an inclined orientation relative to the over-all orientation of machine 10. This helps to insure that, as the papers advance under pressure from push plate 52, they remain upright as depicted.

Also assisting the maintaining the desired orientation for newspapers 14 is a bailer 54 which exerts pressure, opposed to that exerted by the push plate against the rear-most newspaper 14, against the front-most newspaper 14 between dispensing operations.

Referring in combination to FIGS. 5, and 14–17, push plate 52 is threadingly engaged with a threaded rod 56 by way of a coupler 58 which exhibits complimentary threads. The preferred embodiment of Applicants' machine utilizes a poly carbon steel ½"——10TPI—RH double-threaded rod for rod 56. Upon appropriately directed rotation of threaded rod 56, as effected by rod motor 60 to which threaded rod 56 is operably engaged, push plate 52 advances toward the front of machine 10 thereby pushing the newspapers 14 toward the vending position. Rod motor 60 is, in the preferred embodiment of Applicants' machine, a Sumitomo PCY 60, 45 gear motor.

Figure 14:
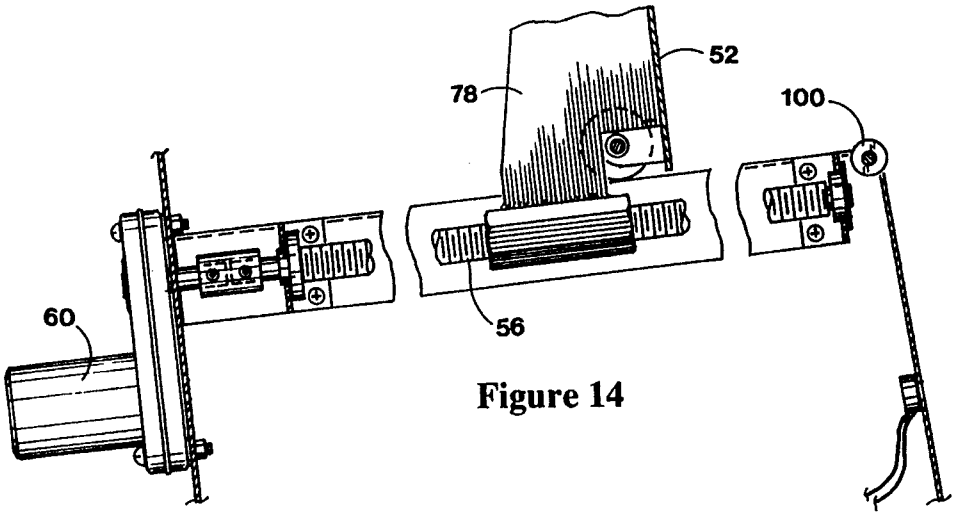
FIG. 14 is a partial, elevational, cross sectional side view of FIG. 9 along line XIV—XIV for emphasis of the push plate and the actuating mechanisms thereof.
Figure 18:
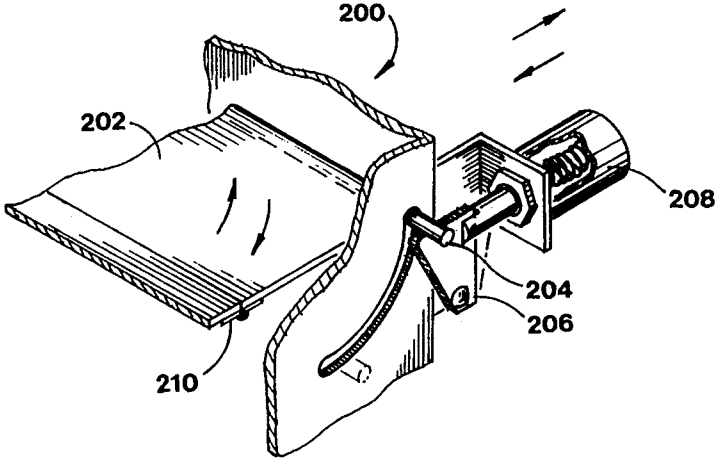
FIG. 18 is a partial perspective, partial cut-away rear view of the trap door mechanism of Applicant's dispensing machine.
Figure 15:
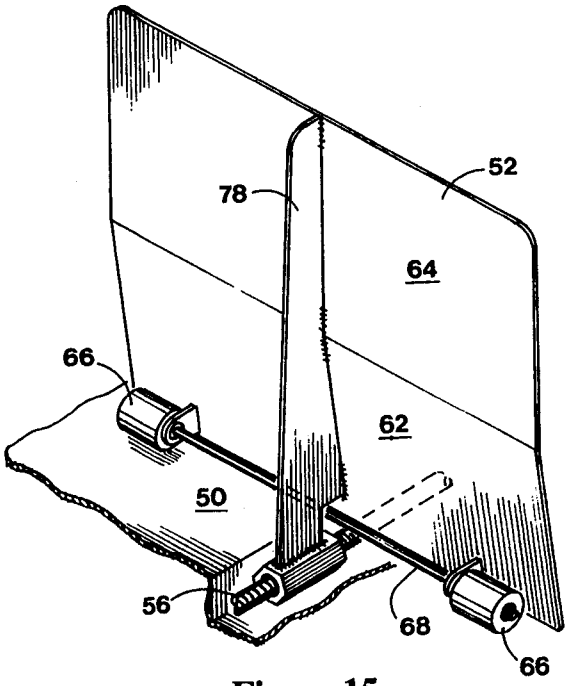
FIG. 15 is a perspective rear view of the push plate of Applicant's dispensing machine.

Referring specifically to FIGS. 5, 14, and 15, push plate 52 rides and is stabilized on platform 50 by two rollers 66 which are attached to push plate 52 by way of an attached axil 68.

Referring specifically to FIG. 15, push plate 52 exhibits two support panels 62 and 64 which are relatively, angularly disposed such that panel 62 is substantially perpendicular to platform 50 and platform 64 is oriented some five degrees (5°) toward vertical from the orientation of panel 62. This configuration has, through extensive experimentation, been determined by Applicant to best preserve the desired orientation of newspapers 14, particularly as they are advanced by force applied by push plate 52. This configuration also insures effective interaction with bailer 52 in allowing only single copies of newspaper 14 to be dispensed at each actuation of machine 10. A single plane push plate (not shown in the drawings) was found to not present the upper-most portions of newspapers to bailer 52 in such as manner that it effectively maintained the front-most newspaper 14 in the proper orientation, nor effectively limited dispensing of newspapers 14 to a single copy upon each actuation of machine 10.

Figure 17:
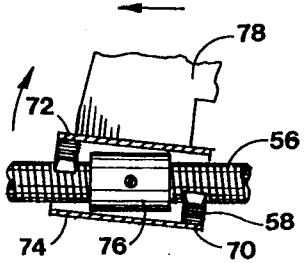
FIG. 17 is a modified depiction of FIG. 16 with coupler 58 is a disengaged position relative to threaded rod 56 for facilitating movement of push plate 52 in a rearward direction for re-stocking of inventory into Applicant's dispensing machine.
Figure 16:
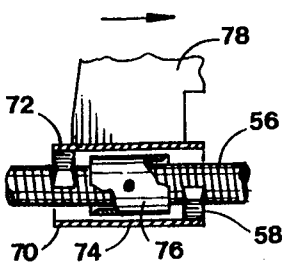
FIG. 16 is a side elevational, partial cross sectional view of the coupler 58 and its engagement with threaded rod 56 of Applicant's dispensing machine.

Referring specifically to FIGS. 16 and 17, a convenient disengaging function for push plate 52 is provided for allowing restocking of machine 10 with newspapers 14 with considerable ease. Coupler 58 engages threaded rod 56 through action to two half-nuts 70 and 72, one above threaded rod 56 and the other below. Half-nuts 70 and 72 are mounted to a half-nut support member 74 which is pivotally attached to a rod collar 76. Rod collar 76 closely envelopes threaded rod 56 and insures that push plate 52 stably progresses in precisely the proper direction as dictated by threaded rod 56. It is also to half-nut support member 74 to which a support spine 78 (shown in FIG. 15) is attached. Between restockings of machine 10, the weight of newspapers 14 against push plate 52, as transmitted to half-nut support member 75 by way of the attached support spine 78, maintains the half-nut support member 76 in the orientation depicted in FIG. 16 whereby half-nuts 70 and 72 are threadingly engaged with threaded rod 56. By pivoting the half-nut support member 74 forward (as shown in FIG. 17), the threads of half-nuts 70 and 72 are disengaged from the threads of threaded rod 56, whereby push plate 52 may easily be moved either forward or backward to accommodate a new inventory of newspapers.

Referring principally to FIGS. 5, 6, 7, 8, 9, 10, 11, 12, and 13, the delivery of a single newspaper 14 involved substantially more than simply advancing the stack of papers along platform 50 as already described. While this advancement places the newspapers 14 in a proper general position for dispensing, careful advancement alone cannot reliably dispense single copies. Also involved in this process, at a minimum, is a friction roller 100, the earlier mentioned bailer 52, and an paper position sensor 102.

Referring principally to FIGS. 5, 6, 7, 8, 9, 12 and 13, friction roller 100 is situated on friction roller axil 98 the axial rotation of which is effected by a friction roller motor 104. As with all motors involved in operation of machine 10, friction roller motor 104 is actuated by a central control module which will be described later. It is the "fine tuned" operation of friction roller 100 which advances a single copy of a newspaper 14 to the vending position (see FIG. 6). After a customer removes a newspaper 14 from the vending position (see FIGS. 7 and 8) a vend position sensor 120 "notifies" the central control unit that another newspaper 14 must be advanced to the vending position. Friction roller 100 is actuated and its frictional interaction with the spine or folded edge of the front-most newspaper 14 which advances the newspaper 14 over the front-most edge of platform 50 to drop to the vending position.

Figure 11:
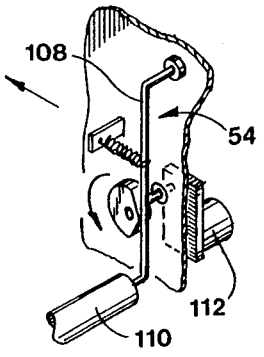
FIG. 11 is a perspective view of an alternative bailer actuating mechanism which substitutes a cam/step motor mechanism for a solenoid.
Figure 10:
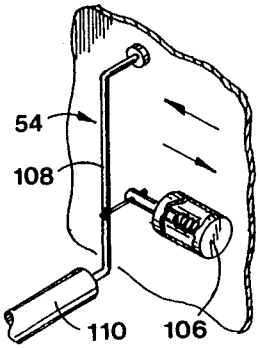
FIG. 10 is a perspective view of a bailer actuating solenoid.
Figure 12:
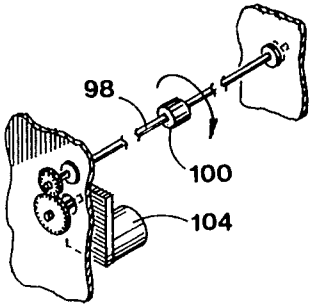
FIG. 12 is a partial perspective view of the mechanism for actuating the friction roller 100 of Applicant's dispensing machine with the platform 50 removed for visualization of such mechanism.
Figure 13:
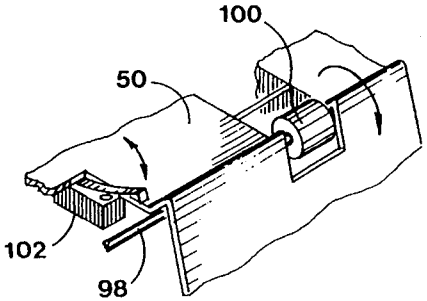
FIG. 13 is a partial perspective view of the forward-most portion of the platform 50 of Applicant's dispensing machine with the vend position sensor 120 being depicted in relation to the forward-most edge of platform 50 and the friction roller 100.
Figure 9:
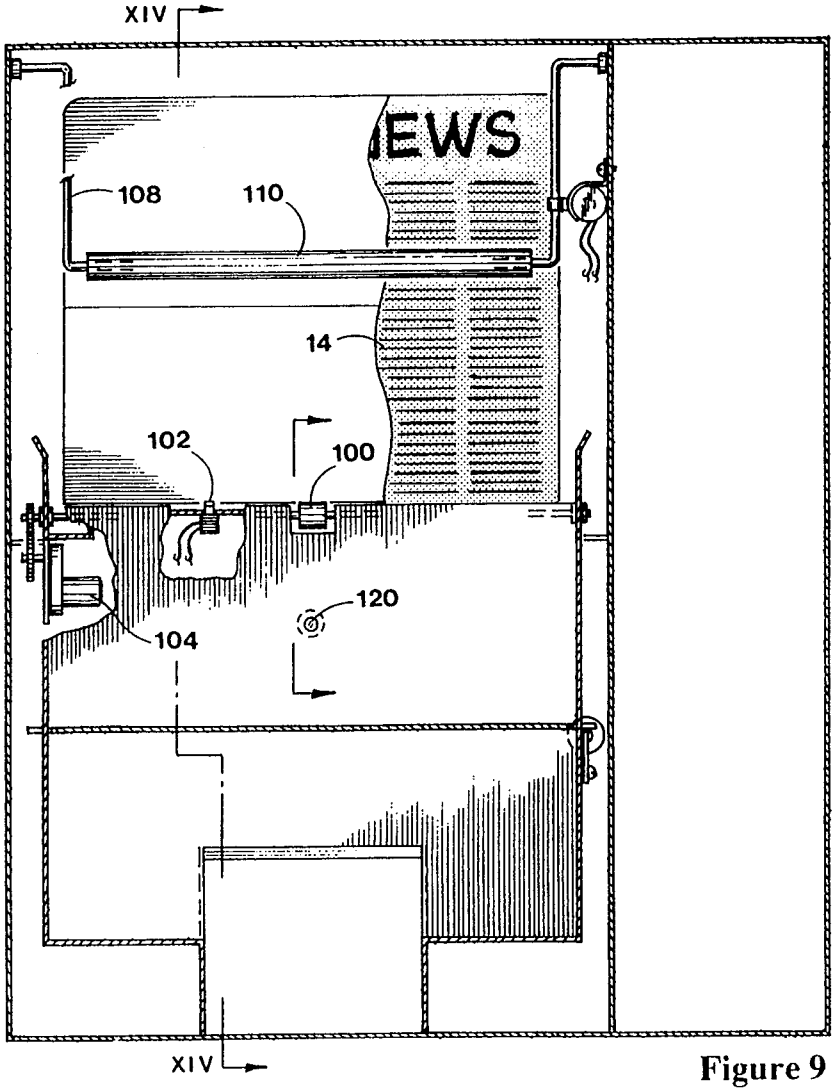
FIG. 9 is a front elevational, cross sectional view along line IX—IX of FIG. 1.

Referring principally to FIGS. 6, 7, 8, 9, 10, and 11 bailer 52 is, in one embodiment shown in FIG. 10, actuated by a bailer solenoid 106 which in turn is actuated by the central control module). As shown in FIG. 11, an alternative embodiment involves actuation of bailer 52 by a cam/step motor unit 112, likewise actuated by the central control module. In either event, the bailer 52 includes lever arms 108 from which is suspended a bailer roller 110 which is rotatably carried at the lower ends of the lever arms 108. Simultaneous with actuation of the friction roller 100 as just described, the central control module actuates bailer solenoid 106 (or cam/-step motor unit 112) such that the bailer roller 110 is withdrawn from contact with the front-most newspaper 14 until that paper drops to the vending position as detected and reported to the central control module by vend position sensor 120.

Referring principally to FIGS. 5, 6, 7, 8 and 18, a trap door mechanism 200 is provided. The trap door mechanism 200 provides several benefits. As opposed to advancing a single copy to a vending position only upon actuation of machine 10 by a customer, a product is immediately available to the customer. Any delay, as would attend just-mentioned alternative, would create a sense of impatience or inconvenience on the part of customers. Also, by advancing newspapers 14 to a vending position, which is spatially and visually distinct from the inventory position, one can insure that the absence of inventory (the machine 10 is empty) is clearly apparent to customers and to route managers. Finally, the trap door mechanism 200 provides additional security for the newspaper inventory.

The trap door mechanism 200 includes a trap door 202, a lock arm 204 attached to the trap door 202. Positioned to operably interact with lock arm 204 is a solenoid actuated cam lock 206 actuated by trap door solenoid 208. Trap door solenoid 208 is controlled by the central control module. Trap door 202 is biased toward its closed position (see FIG. 6) by a spring hinge 210.

The sequence of steps involved in a purchase transaction involving machine 10 (assuming a single unit) is as follows:

(1) customer inserts adequate purchase tender for purchasing one newspaper 14;

(2) central control module actuates and deactivates trap door solenoid 208 thereby allowing a newspaper to drop to the level of slot 20 (once paper is removed, trap door 202 will spring back to its closed position and be locked into place by spring biased cam lock 206);

(3) upon receiving indication from vend position sensor 120 that newspaper 14 has been removed by the customer, central control module actuates friction roller motor 104 and bailer solenoid 106 until vend position sensor 120 indicates that a newspaper 14 is again in the vending position;

(4) central control module then deactivates bailer solenoid 106 and actuates rod motor 60 until paper position sensor 102 detects passage of one paper to the position for engaging friction roller 100.

Figure 19:
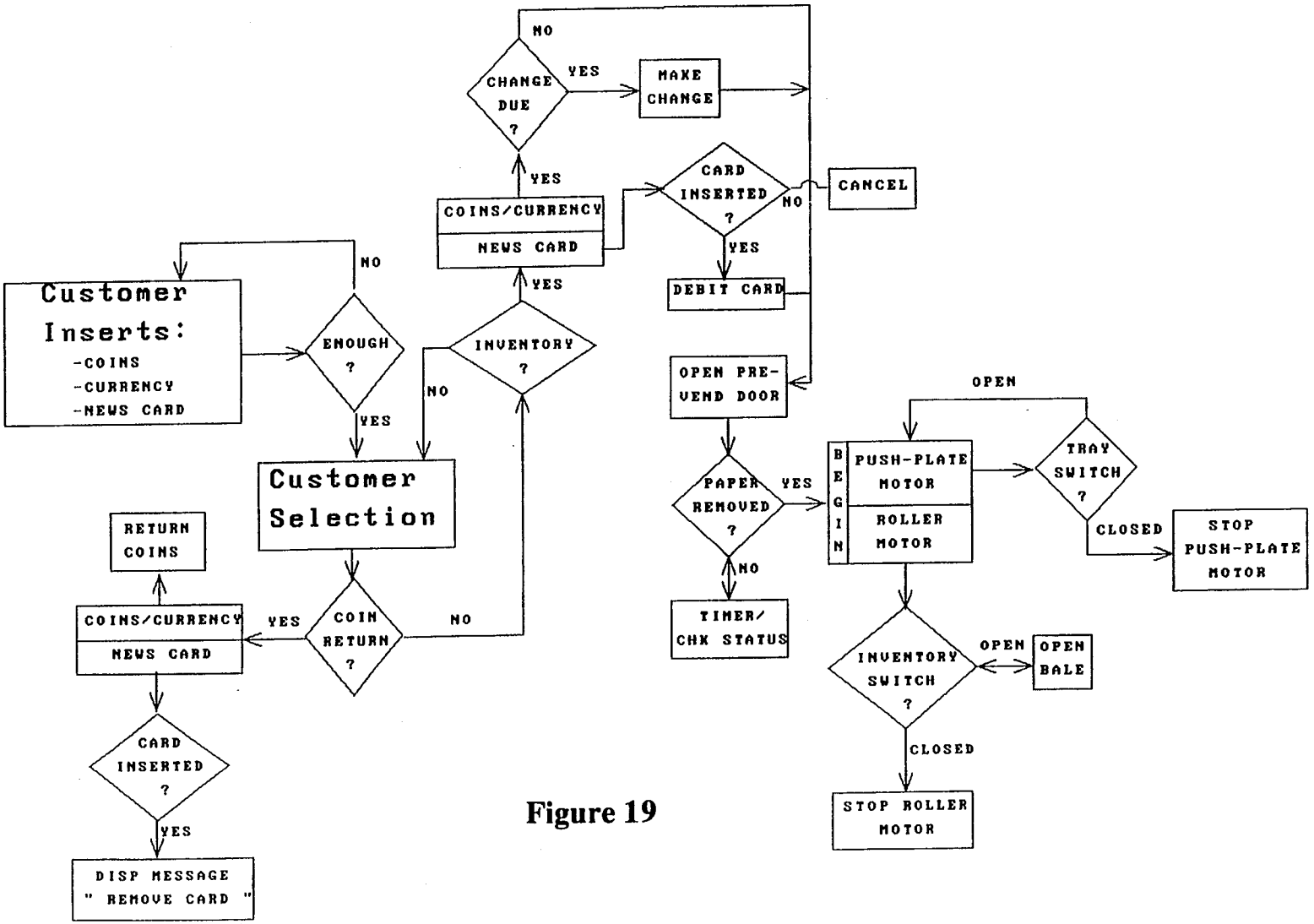
FIG. 19 is a flow chart depicting logic to be applied by the central control unit of Applicant's dispensing machine.

Referring to FIG. 19, a flow chart is depicted which indicates the logic applied by a central control module used to govern machine 10. Note that the logic depicted assumed installation of a smart card reader/writer as mentioned above, and the logic includes queries as to sufficiency of available balance on the card, etc.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A single vend media dispensing device comprising:

a platform for supporting multiple media units, said platform having a vend position edge;

a push plate member moveable relative to said platform and positioned for advancing said media units along said platform toward a position adjacent to said vend position edge, said push plate member being actuated by push plate motor means and governed by push plate control means for deactivating said push plate motor when a front-most media unit reaches said vend position edge of said platform;

friction roller means adjacent to said vend position edge of said platform, said friction roller means being positioned for frictionally engaging a first said media unit and moving said media unit beyond said vend position edge to a vending hopper, said friction roller means being actuated by a friction roller motor which operates only until a second said media unit reaches said vend position edge.

2. The apparatus of claim 1 further comprising:

disengageable biasing means positioned for maintaining a first said media unit in a position for advancing beyond said vending position edge into said vending hopper under force of said push plate member.

3. The apparatus of claim 2 further comprising hopper access gate means.

* * * * *

UNITED STATES PATENT AND TRADEMARK OFFICE

CERTIFICATE OF CORRECTION

PATENT NO. : 5,400,919

DATED : March 28, 1995

INVENTOR(S) : R. Greg Gomm, et al

It is certified that error appears in the above-identified patent and that said Letters Patent is hereby corrected as shown below:

On the title page, item [76], change "Gregg" to --Greg--.

Signed and Sealed this

Thirteenth Day of June, 1995

*Attest:*

*Attesting Officer*

BRUCE LEHMAN

*Commissioner of Patents and Trademarks*